US006929344B2

(12) United States Patent
Hwang

(10) Patent No.: US 6,929,344 B2
(45) Date of Patent: Aug. 16, 2005

(54) APPARATUS AND METHOD FOR DETECTING PAPER SKEW IN INK-JET PRINTER

(75) Inventor: In-su Hwang, Daejeon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 141 days.

(21) Appl. No.: 10/652,617

(22) Filed: Sep. 2, 2003

(65) Prior Publication Data

US 2004/0119771 A1 Jun. 24, 2004

(30) Foreign Application Priority Data

Nov. 6, 2002 (KR) ..... 10-2002-0068368

(51) Int. Cl.[7] ..... B41J 29/393; B65H 9/16
(52) U.S. Cl. ..... 347/19; 347/105; 271/227
(58) Field of Search ..... 347/19, 105, 157; 271/10.02, 10.03, 226, 227, 258.01, 259, 153

(56) References Cited

U.S. PATENT DOCUMENTS 5,041,850 A * 8/1991 Kahoyashi et al. ..... 347/157
5,324,021 A * 6/1994 Onomoto et al. ..... 271/227

FOREIGN PATENT DOCUMENTS

KR P1990-0017793 12/1990
KR 94002126 3/1994

* cited by examiner

*Primary Examiner*—Lamson Nguyen
(74) *Attorney, Agent, or Firm*—Staas & Halsey LLP

(57) ABSTRACT

A paper skew detection apparatus in an ink-jet printer. The paper skew detection apparatus includes a first light emitter positioned below the paper being transported to irradiate light onto the paper; a second light emitter spaced apart from the first light emitter a predetermined distance and positioned below the paper being transported to irradiate light onto the paper; and a detector positioned on one side of a carriage to receive light emitted by the first and second light emitters. Here, the carriage holds an ink cartridge, below which a print head to discharge ink is installed, and reciprocates rectilinearly in a direction orthogonal to a transport direction of the paper.

26 Claims, 5 Drawing Sheets

PRIOR ART

APPARATUS AND METHOD FOR DETECTING PAPER SKEW IN INK-JET PRINTER

CROSS-REFERENCE TO RELATED APPLICATIONS

This application claims priority from Korean Patent Application No. 2002-68368, filed Nov. 6, 2002, the disclosure of which is incorporated herein by reference in its entirety.

BACKGROUND OF THE INVENTION

1. Field of the Invention

The present invention relates to a paper skew detection apparatus for use in an ink-jet printer, and more particularly, to a paper skew detection apparatus in an ink-jet printer capable of detecting paper skew by measuring the amount of light emitted by a plurality of light emitters.

2. Description of the Related Art

Ink-jet printers print images by spraying ink onto a paper sheet while an ink cartridge installed on a carriage is moving horizontally. FIG. 1 is a perspective view showing an example of a conventional ink-jet printer. Referring to FIG. 1, the conventional ink-jet printer has a paper feeding unit 11 that loads paper P and feeds each sheet into the printer for printing. The paper P loaded in the paper feeding unit 11 is transported to the bottom of an ink-jet print head by a linefeed roller (not shown) rotatably driven by a linefeed motor (not shown).

A carriage 13 having an ink cartridge 12 to hold ink is driven by a driving unit 14 to reciprocate linearly over the paper P. The ink-jet print head sprays ink to form an image on the paper P. The paper P on which the image has been formed is transported to a paper delivering table 15 by a delivery roller and is delivered.

In the conventional ink-jet printer configured above, a user may not place the paper P correctly into the paper feeding unit 11, or the paper P may be misfed into the printer. Then, the ink-jet print head forms an image by directing ink onto the skewed paper P. When subject to paper skew in this way, the paper P is wrinkled or torn during a printing process. Furthermore, the paper P is not delivered to the paper delivering table 15 in a desired state (indicated by line A) but in a slanted state (indicated by line B), thus causing the ink-jet print head to print the image in a skewed or slanted position on the paper P.

SUMMARY OF THE INVENTION

Accordingly, it is an aspect of the present invention to provide a paper skew detection apparatus in an ink-jet printer capable of detecting a skew by using a difference in the amounts of light emitted by a plurality of light emitters and displaying the skew to a user if a paper is misfed.

Additional aspects and advantages of the invention will be set forth in part in the description which follows and, in part, will be obvious from the description, or may be learned by practice of the invention.

The foregoing and/or other aspects of the present invention are achieved by providing a paper skew detection apparatus in an ink-jet printer having an ink cartridge, a carriage to hold the ink cartridge, and a print head to discharge ink from the ink cartridge and move rectilinearly, which detects skew in a paper being fed into the printer in a direction orthogonal to the movement of the ink cartridge, the apparatus including a first light emitter to irradiate light onto the paper; a second light emitter spaced apart from the first light emitter to irradiate light onto the paper; and a detector positioned on a side of the carriage to receive the light from the first and second light emitters, wherein if an amount of the light irradiated by the first light emitter is different from an amount of the light irradiated by the second light emitter, the paper is determined to have been skewed.

The foregoing and/or other aspects of the present invention may also be achieved by providing a paper skew detection apparatus in an ink-jet printer, which detects skew in a paper being fed into the printer, the apparatus including a first sensor including a first light emitter that irradiates light onto the paper and a first light receiver that receives the light irradiated by the first light emitter and reflected from the paper, and a second sensor spaced apart from the first sensor and including a second light emitter that irradiates light onto the paper and a second light receiver that receives the light irradiated by the second light emitter and reflected from the paper, wherein if amounts of the lights received by the first and second light receivers are different from each other, the paper is determined to have been skewed.

The foregoing and/or other aspects of the present invention may also be achieved by providing a method of detecting a paper skew of an ink-jet printer. The method includes feeding a paper to a predefined position; receiving light emitted by a plurality of light emitters in a direction perpendicular to a direction of the feeding; determining whether amounts of the received light are equal to each other; and outputting a skew message based upon the determining.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
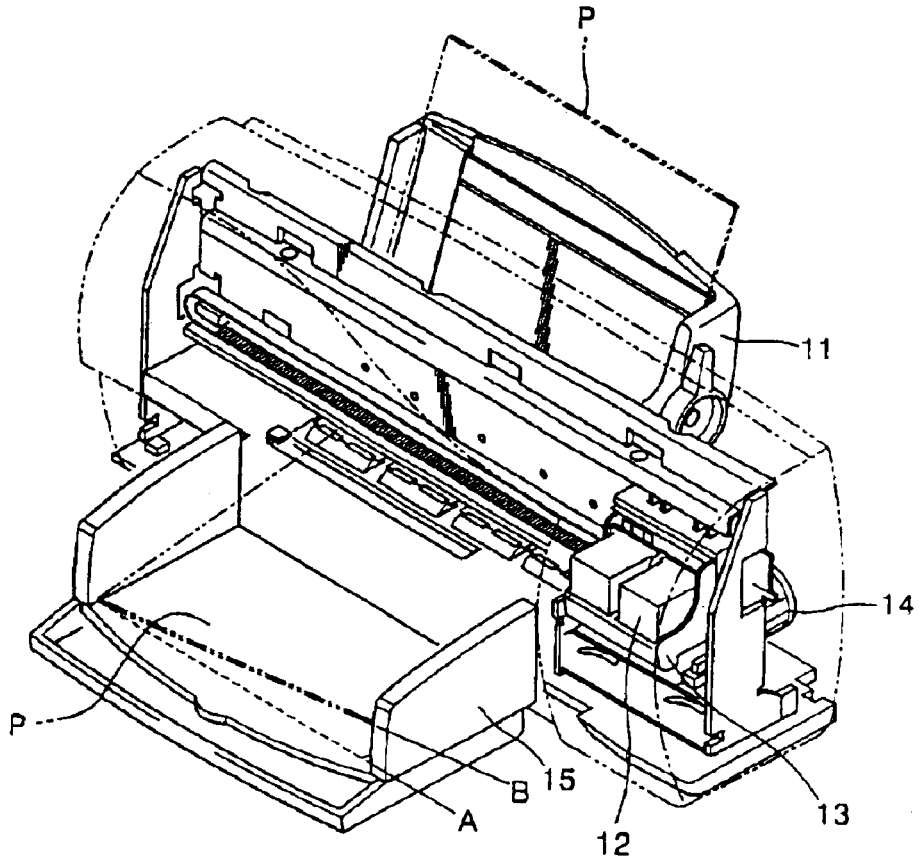
FIG. 1 is a perspective view showing an example of a conventional ink-jet printer.

Reference will now be made in detail to the present preferred embodiments of the present invention, examples of which are illustrated in the accompanying drawings, wherein like reference numerals refer to like elements throughout.

Figure 2:
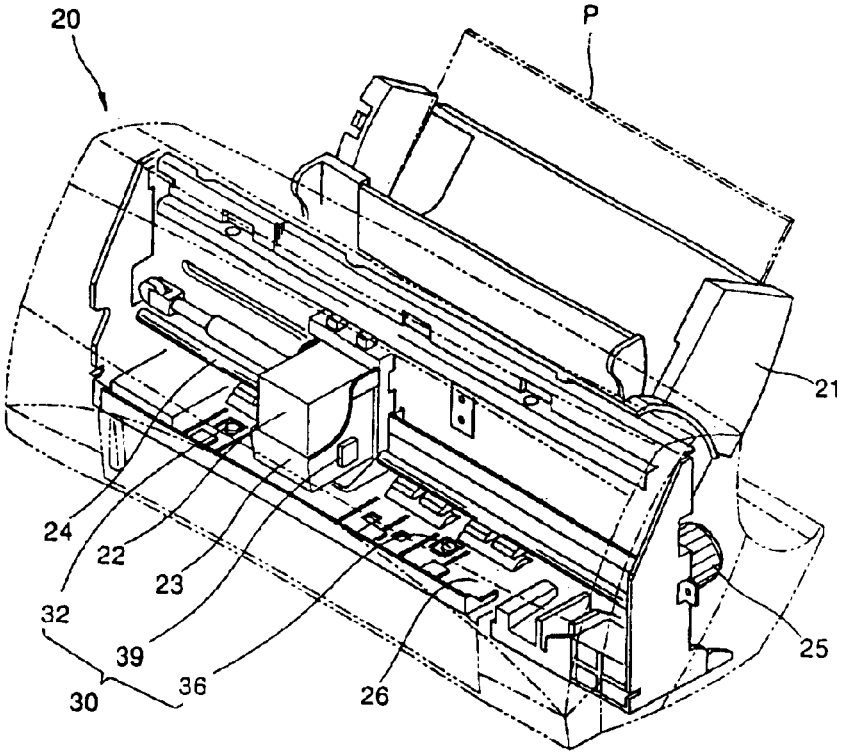
FIG. 2 is a perspective view of an ink-jet printer incorporating a paper skew detection apparatus according to a first embodiment of the present invention.

Referring to FIG. 2, an ink-jet printer 20 includes a paper feeder 21 that loads paper P and feeds the paper P into the printer 20 for printing. The paper P loaded in the paper feeder 21 is transported to the bottom of an ink-jet print head by a linefeed roller (not shown).

The ink-jet printer 20 further includes a carriage 23 with an ink cartridge 22 to hold ink being installed therein. The carriage 23 slides into a carriage shaft 24 and driven by a driving unit 25 to reciprocate linearly over the paper P. The ink-jet print head located at the bottom of the ink cartridge 22 sprays ink to form an image on the paper P. The paper P on which the image has been formed is delivered to the outside by a delivery roller (not shown).

The inkjet printer 20 also has a paper skew detection apparatus 30 to detect skew in the paper P. The paper skew detection apparatus 30 includes first and second light emitters 32 and 36 and a detector 39. The first light emitter 32 is installed into a first hole 31 (FIG. 3) and irradiates light onto the paper P. Here, the first hole 31 is formed in a frame 26 of the ink-jet printer 20, which is located below the paper P being transported. The second light emitter 36 is spaced apart from the first light emitter 32 a predetermined distance and installed into a second hole 35 so that it irradiates light onto the paper P. The second hole 35 is formed in the frame 26 located below the paper P being transported. The first and second light emitters 32 and 36 are installed along the same line in the direction orthogonal to a transport direction of the paper P for easier measurement of a skew in the paper P being transported.

The first and second light emitters 32 and 36 are light emitting diodes (LEDs) that emit light. First and second transparent plates 33 and 37, through which light emitted by the first and second light emitters 32 and 36 propagates, are installed to cover the first and second holes 31 and 35. The first and second transparent plates 33 and 37 are provided to prevent the paper P passing over the first and second holes 31 and 35 from contacting the first and second light emitters 32 and 36. Thus, the first and second transparent plates 33 and 37 can be made of any material through which light can propagate.

The detector 39 is positioned on one side of the carriage 23 and receives light emitted by the first and second light emitters 32 and 36. The detector 39 moves above the first light emitter 32 in order to receive light emitted by the first light emitter 32 and then moves above the second emitter 36 in order to receive light emitted by the second light emitter 36. Thus, the detector 39 is located perpendicular to the first or second light emitters 32 or 36 to receive light emitted from the first or second light emitter 32 or 36.

The detector 39 is connected to a micro-processor. First light emitted by the first light emitter 32 is received by the detector 39 and stored in the micro-processor. Second light emitted by the second light emitter 36 is received by the detector 39 and is stored in the micro-processor. As will be described later, the micro-processor compares the amounts of the first and second light with each other and determines whether the paper P is skewed.

Figure 3:
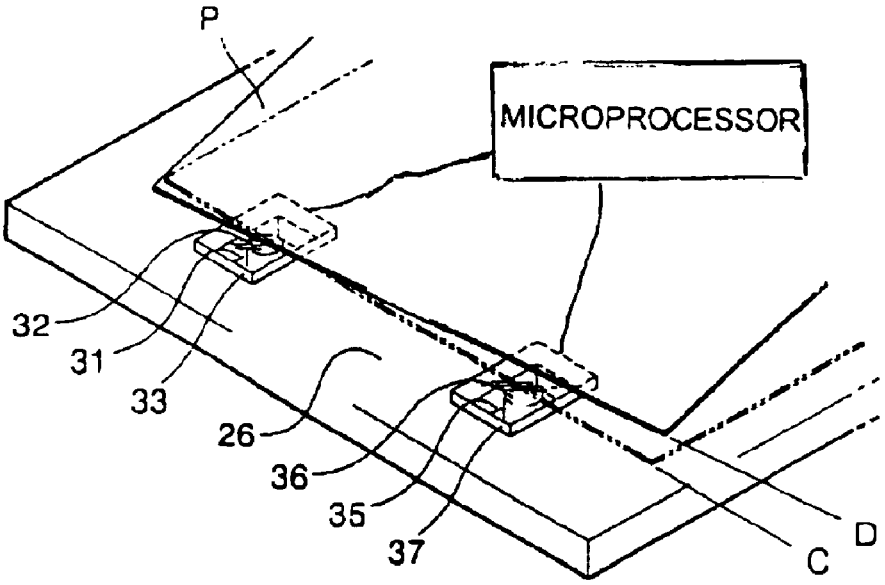
FIG. 3 is a perspective view of the paper skew detection apparatus according to the first embodiment of this invention.

The operation of the paper skew detection apparatus 30 according to a first embodiment of the present invention will now be described with reference to FIGS. 2 and 3.

The paper P loaded in the paper feeder 21 is moved to a predefined position by a linefeed roller during printing. In this case, the predefined position is defined as a position existing in front of the print head in the direction the paper P is transported. This is because it is necessary for the print head to check the occurrence of paper skew before printing begins.

As the carriage 23, located in a home position, travels above the paper P to a position above the first light emitter 32, the detector 39 receives light emitted by the first light emitter 32. Then, as the carriage 23 travels to a position above the second light emitter 36, the detector 39 receives light emitted by the second light emitter 36. In this case, since the paper P is placed in a position D deviated from a reference position C at a predetermined angle, there is a difference between the areas of the paper P covering the first and second light emitters 32 and 36. That is, the area of the paper P covering the first light emitter 32 is larger than that covering the second light emitter 36. This means that the amount of light emitted by the first light emitter 32 and received by the detector 39 is less than the amount of light emitted by the second light emitter 36 and received by the detector 39. The micro-processor determines the amount of paper skew using the difference in the amount of light as described above.

Figure 4:
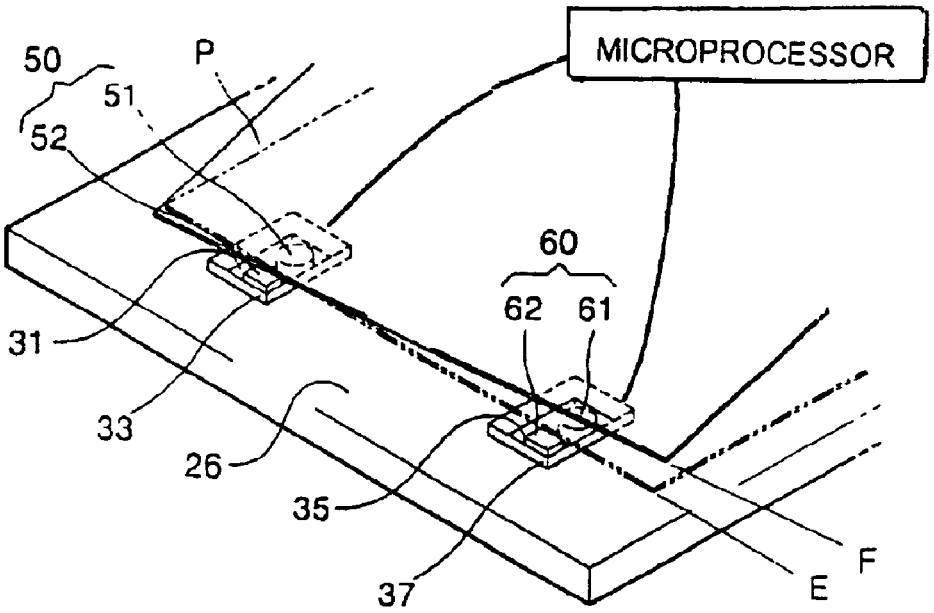
FIG. 4 is a perspective view of a paper skew detection apparatus according to a second embodiment of this invention.
Figure 5:
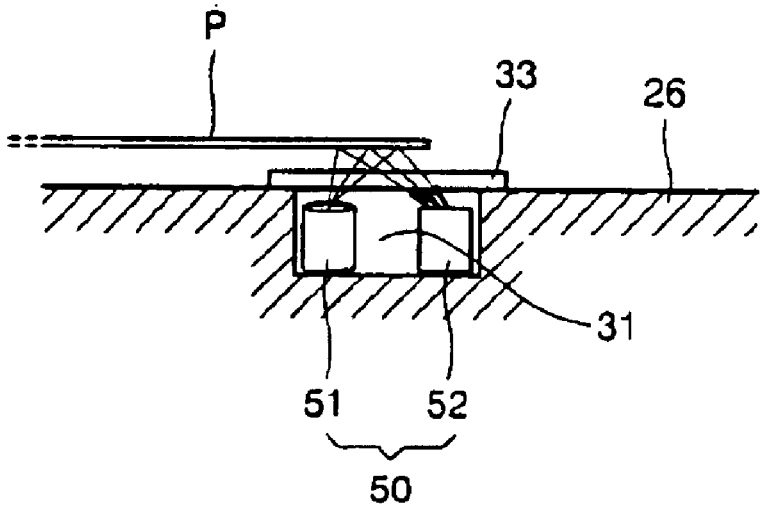
FIG. 5 is a cross-section of the paper skew detection apparatus of FIG. 4 for explaining the operation of the first sensor shown in FIG. 4.
Figure 6:
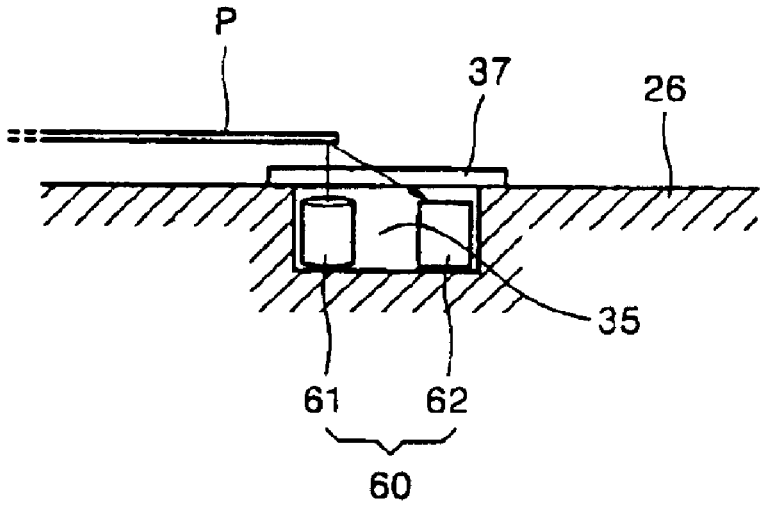
FIG. 6 is a cross-section of the paper skew detection apparatus of FIG. 4 for explaining the operation of the second sensor shown in FIG. 4.

FIG. 4 is a perspective view of a paper skew detection apparatus according to a second embodiment of the present invention, and FIGS. 5 and 6 are cross-sections of the paper skew detection apparatus of FIG. 4 to explain the operation of first and second sensors 50 and 60 shown in FIG. 4.

The first sensor 50 includes a third light emitter 51 and a first light receiver 52. The third light emitter 51 is installed into the first hole 31 and irradiates light onto the paper P. Here, the first hole 31 is formed in the frame 26 of the ink-jet printer 20, which is located below the paper P being transported. The first light receiver 52 is installed close to the third light emitter 51 into the first hole 31 and receives light emitted by the third light emitter 51 and reflected from the paper P. The third light emitter 51 and the first light receiver 52 are aligned in the direction the paper P is transferred.

The second sensor 60 is spaced apart from the first sensor 50 a predetermined distance and configured to have a fourth light emitter 61 and a second light receiver 62. The fourth light emitter 61 is installed into the second hole 35 and irradiates light onto the paper P. Here, the second hole 35 is formed in the frame 26 of the ink-jet printer 20, which is located below the paper P being transported. The second light receiver 62 is installed close to the fourth light emitter 61 into the second hole 35 and receives light emitted by the fourth light emitter 61 and reflected from the paper P. The fourth light emitter 61 and the second light receiver 62 are aligned in the direction in which the paper P is transferred.

The third and fourth light emitters 51 and 61 are light emitting diodes (LEDs) that emit light. The first and second transparent plates 33 and 37, through which light emitted by the third and fourth light emitters 51 and 61 propagates, are installed to cover the first and second holes 31 and 35. The first and second transparent plates 33 and 37 are provided to prevent the paper P passing over the first and second holes 31 and 35 from contacting the third and fourth light emitters 51 and 61. Thus, the first and second transparent plates 33 and 37 can be made of any material through which light can propagate.

The operation of the paper skew detection apparatus 30 according to the second embodiment of the present invention will now be described with reference to FIGS. 2, 4, 5, and 6.

The paper P loaded in the paper feeder 21 is moved to a predefined position by the linefeed roller during a printing process. The third and fourth light emitters 51 and 61 irradiate light onto the paper P. In this case, the first and second light receivers 52 and 62 receive light emitted by the third and fourth light emitters 51 and 61, respectively, and reflected off the paper P.

Since the paper P is placed in a position F skewed away from a reference position E at a predetermined angle, there is a difference between the areas of the paper P covering the third and fourth light emitters 51 and 61. That is, the amount of light received by the first light receiver 52 after having been emitted by the third light emitter 51 and reflected off the paper P is larger than that received by the second light receiver 62 after having been emitted by the fourth light emitter 61 and reflected off the paper P. The micro-processor determines paper skew using the difference between the amounts of light received by the first and second light receivers 52 and 62.

Figure 7:
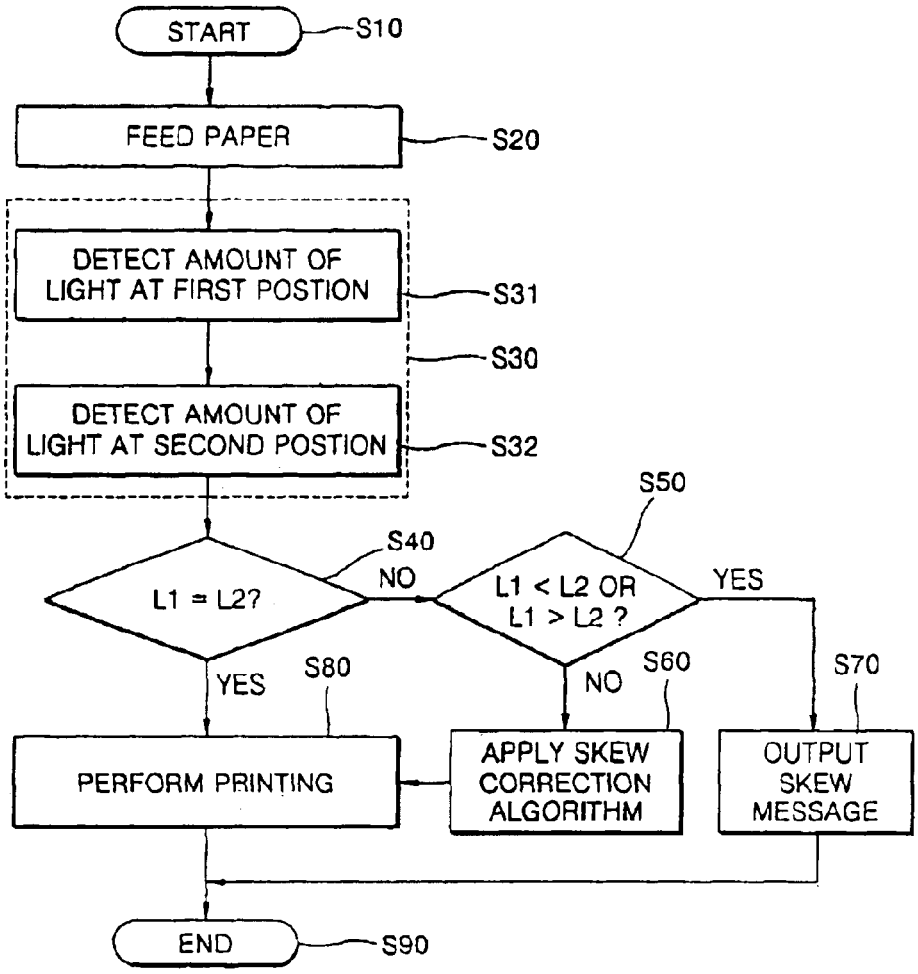
FIG. 7 is a flow chart illustrating a paper skew detection method according to the first embodiment of this invention.

FIG. 7 is a flow chart illustrating a paper skew detection method according to the first embodiment of this invention. Referring to FIGS. 2 and 7, the paper skew detection method is performed using the following procedures. In operation S10, the paper P is loaded in order to begin the desired operation in the ink-jet printer 20. In operation S20, the paper P loaded during S10 is fed to a predefined position. In operation S30, the detector 39 passes above the paper P fed to the predefined position in operation S20 and receives a predetermined amount of light from the first and second light emitters 32 and 36.

Operation S30 is broken down into operations S31 and S32. In operation S31, which is a first detection operation, the detector 39 receives light emitted by the first light emitter 32 at a first position. In operation S32, which is a second detection operation, the detector 39 moved to a second position receives light emitted by the second light emitter 36.

In operation 40, it is determined whether the amounts of light received in operation S30 are equal to each other. In operation S50, if the amounts of light are different from each other, the degree of difference is determined. In operation 60, if the difference between the amounts of light is small enough to correct a skew, then a skew correction algorithm is applied. In operation S70, if the difference between the amounts of light is too large to correct a skew, a skew message is displayed. In operation S80, if the amounts of light are equal to each other, printing continues to be performed. In operation S90, the paper skew detection procedure is terminated by completing printing performed in operation S80 or by displaying the skew message in operation S70.

The paper skew detection method performed above will now be described in detail. In operation S10, a user loads the paper P in the paper feeder 21. In operation S20, the linefeed roller feeds the loaded paper P to a predefined position when printing begins. In operation S31, when the carriage 23 moves to the first position, the detector 39 receives light rays not intercepted by the paper P, among the light rays emitted from the first light emitter 32. In operation S32, when the carriage 23 moves to the second position, the detector 39 receives light rays not intercepted by the paper P, among the light rays emitted by the second light emitter 36. In operation S40, where the amounts of light received at the first and second positions are L1 and L2, respectively, it is determined whether L1 equals L2. In operation S80, if L1=L2, the ink-jet print head located at the bottom of the ink cartridge 22 performs printing by spraying ink to form an image on the paper P. If L1 does not equal L2, it is determined whether L1 is greater or less than L2 in operation S50, and then the difference between L1 and L2 is determined. If the difference between L1 and L2 is less than a preset value, a skew correction algorithm is applied (step S60), and the ink-jet print head performs printing by spraying ink to form an image on the paper P (S80). If the difference between L1 and L2 is greater than or equal to the preset value, a skew message is displayed (S70) and the process is terminated (S90).

A paper skew detection method according to the second embodiment of the present invention is performed in the same manner as in the first embodiment except for the operation S30 to receive the amount of light. That is, according to the second embodiment, in S30, the first and second light receivers 52 and 62 simultaneously receive light emitted from the third and fourth light emitters 51 and 61, respectively.

As described above, a paper skew detection apparatus according to the present invention detects the degree of a skew by comparing the amount of light received from a plurality of light emitters, thus making it possible to print an image in the correct position on the paper.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A paper skew detection apparatus in an ink-jet printer having an ink cartridge, a carriage to hold the ink cartridge, and a print head to discharge ink from the ink cartridge and move rectilinearly, which detects skew in a paper being fed into the printer in a direction orthogonal to the movement of the ink cartridge, the apparatus comprising:

a first light emitter to irradiate light onto the paper;

a second light emitter spaced apart from the first light emitter to irradiate light onto the paper; and a detector positioned on a side of the carriage to receive the light from the first and second light emitters, wherein if an amount of the light irradiated by the first light emitter is different from an amount of the light irradiated by the second light emitter, the paper is determined to have been skewed.

2. The apparatus of claim 1, wherein the first and second light emitters are installed in holes formed in a main body of the ink-jet printer.

3. The apparatus of claim 1, wherein the first and second light emitters are disposed from the print head orthogonal to the direction of movement of the paper.

4. The apparatus of claim 1, further comprising first and second transparent plates positioned on the first and second light emitters, respectively, to pass the irradiated light.

5. The apparatus of claim 1, wherein the first and second light emitters comprise light emitting diodes (LEDs).

6. A paper skew detection apparatus in an ink-jet printer, which detects skew in a paper being fed into the printer, the apparatus comprising:

a first sensor comprising a first light emitter that irradiates light onto the paper and a first light receiver that receives the light irradiated by the first light emitter and reflected from the paper, and a second sensor spaced apart from the first sensor and comprising a second light emitter that irradiates light onto the paper and a second light receiver that receives the light irradiated by the second light emitter and reflected from the paper, wherein if amounts of the lights received by the first and second light receivers are different from each other, the paper is determined to have been skewed.

7. The apparatus of claim 6, wherein the first and second light emitters comprise light emitting diodes (LEDs).

8. The apparatus of claim 6, further comprising first and second transparent plates positioned on the first and second sensors, respectively, to pass the irradiated light.

9. The apparatus of claim 6, wherein the first and second light emitters are installed in holes formed on a main body of the ink-jet printer.

10. The apparatus of claim 6, wherein the first and second light emitters are disposed from the print head along a feed direction of the paper.

11. The apparatus of claim 6, wherein the first light emitter and the first light receiver are aligned in a feed direction of the paper, and the second light emitter and the second light receiver are aligned in the feed direction of the paper.

12. A method of detecting a paper skew in an ink-jet printer, the method comprising:

feeding a paper to a predefined position;

receiving light emitted by a plurality of light emitters in a direction perpendicular to a direction of the feeding;

determining whether amounts of the received light are equal to each other; and outputting a skew message based upon the determining.

13. The method of claim 12, wherein the receiving the light comprises:

emitting a first light from a first light emitter;

moving a detector to a first position on the fed paper and receiving the first light;

emitting a second light from a second light emitter; and moving the detector to a second position on the paper and receiving the second light.

14. The method of claim 12, further comprising:

determining if amounts of the received first and second lights are different; and determining a degree of difference between the amounts of the received first and second lights if the amounts of the first and second lights are determined to be different.

15. The method of claim 14, further comprising applying a skew correction algorithm and performing printing if the determined difference is less than a preset value.

16. The method of claim 14, further comprising performing printing if the amounts of the received first and second lights are determined not to be different.

17. An apparatus comprising:

a first light emitter to emit a first light to a paper;

a second light emitter to emit a second light to the paper;

a detector to detect the first and second lights; and a comparing unit to compare the detected first and second lights and determine a skew of the paper therefrom.

18. The apparatus of claim 17, wherein the detected first and second lights are reflected from the paper.

19. The apparatus of claim 18, wherein the detector comprises first and second detecting units to respectively detect the first and second lights.

20. The apparatus of claim 19, wherein the first and second detecting units are on opposite sides of the paper.

21. The apparatus of claim 19, wherein the first and second detecting units are on a same side of the paper.

22. An image forming apparatus comprising:

a feeder to feed a paper; and a skew detector comprising:

a first light emitter to emit a first light to the paper, a second light emitter to emit a second light to the paper, a detector to detect the first and second lights, and a comparing unit to compare the detected first and second lights and determine a skew of the paper therefrom.

23. The apparatus of claim 22, further comprising a carriage to support the detector and move in a direction perpendicular to a feed direction of the paper.

24. A method comprising:

emitting a first light to a paper;

emitting a second light to the paper;

detecting the first and second lights; and comparing amounts of the detected first and second lights to determine a skew of the paper.

25. The method of claim 24, further comprising feeding the paper, wherein the detecting comprises moving a detector between the first and second lights in a direction perpendicular to a feed direction of the paper.

26. The method of claim 25, further comprising:

determining the skew if the compared amounts differ;

determining an amount of difference between the compared amounts if the skew is determined;

correcting the skew if the determined amount of difference is below a predetermined value; and displaying a skew message if the determined amount of difference is above the predetermined value.

* * * * *